US005638873A

United States Patent [19]

Burns

[11] Patent Number: 5,638,873

[45] Date of Patent: Jun. 17, 1997

[54] SIPHONING FUNNEL DEVICE

[76] Inventor: Forrest C. Burns, 122 Hammock La., Gray, Tenn. 37615

[21] Appl. No.: 644,745

[22] Filed: May 10, 1996

[51] Int. Cl.[6] ..... B65B 1/04; B65B 3/04; B67C 3/18

[52] U.S. Cl. ..... 141/230; 141/198; 141/297; 141/340

[58] Field of Search ..... 141/230, 198, 141/199, 297, 298, 299, 300, 340, 341, 342, 343

[56] References Cited

U.S. PATENT DOCUMENTS 2,850,050 9/1958 Connolly ..... 141/300

*Primary Examiner*—Renee S. Luebke

*Assistant Examiner*—Timothy L. Maust

[57] ABSTRACT

A funnel device having an adjustable fill regulator mechanism of a flexible siphon tube extending thru the funnel wall and into the neck of the funnel and making lateral frictional contact with an inner wall portion of the neck, the suction end of the tube having a siphon inlet which can be positioned within the neck or completely therethrough by bowing the portion of the tube lying within the funnel, the frictional contact being sufficient to retain the inlet in a position as required for filling or emptying a tank to a desired level by siphoning action.

5 Claims, 1 Drawing Sheet

SIPHONING FUNNEL DEVICE

BACKGROUND OF THE INVENTION

1. Field of the Invention

This invention concerns a funnel device for use in filling tanks or other receptacles in general of any capacity, and especially for filling relatively small capacity gasoline tanks, i.e., 2–10 gallons, such as are mounted on lawn or garden motorized equipment, e.g., hand controlled or riding lawn motors and rototillers, or such as are used in motor boats, especially outboards.

The filling of such tanks typically results in overflow of the tank and spillage of environmentally deleterious and hazardous gasoline on the equipment, soil and vegetation, and in the case of boats, in the bilge wherein explosion, fire and death are the common results. Such overflowing is almost a natural aspect of filling small tanks to their capacity since the rising gasoline level during filling is not readily visible and excess gasoline is typically poured into the funnel and runs out around the funnel neck.

2. Description of the Prior Art

Previous funnel structures which have been proposed for preventing such spillage and which have included siphoning mechanisms of various designs are shown in U.S. Pat. Nos. 4,273,166; 1,705,312; 1,810,822; 657,080; 4,494,585, the general disclosures of which in regard to useful funnel shapes, structural and siphon hose materials, and utility are hereby incorporated herein by reference in their entirety.

It is particularly noted that in these prior devices, the siphon tubes or the like are fixed in both position and dimension on the funnel body or neck. This arrangement mandates that the tank always be filled to the siphon level, e.g., line 46 of the above noted U.S. Pat. No. 4,273,166, or that it be filled to some intermediate level below the siphon level, which intermediate level the person filling the tank cannot observe and must guess at.

OBJECTS OF THE INVENTION

A principal object therefore, of the present invention is to provide an inexpensive, simply constructed and durable funnel device particularly adapted for filling small gasoline tanks to a desired level at or below the maximum capacity of the tank, wherein easily useable and convenient means is provided for insuring that a particular selected fill level, without spillage is achieved.

SUMMARY OF THE INVENTION

The above and other objects hereinafter appearing have been attained in accordance with the present invention thru the discovery of a funnel device having adjustable fill regulator means for pouring fluids into a receptacle thru a fill port therein defined by a perimeter wall, said device comprising a funnel shaped body having a wide-mouthed fluid entry section and an integral tubular neck section having a fluid exit and a flow axis, pressure seal means on an exterior circumferential surface portion of said body and adapted to engage the perimeter wall of said fill port and form a hermetic seal between said circumferential surface portion and said perimeter wall, aperture means formed thru a wall portion of said entry section and having a bore axis, and flexible siphon tube means having a suction end segment, an intermediate segment and a discharge end segment, said discharge end segment extending outwardly of said body, said intermediate segment being sealingly mounted in and thru said aperture means with said suction end segment extending into said entry section and said neck section and making lateral frictional contact with an inner wall portion of said neck section, said suction end segment having a siphon inlet adapted for positioning within said neck section or completely therethrough and protruding beyond said exit, said suction end segment being movable against said frictional contact in a generally flow axial direction within said neck section for positioning said siphon inlet generally axially with respect to said neck section, said suction end segment having a bow sector adjacent said aperture means, the curvature configuration of said bow sector being determined approximately by the adjusted distance between said aperture means and said siphon inlet, wherein the position of said siphon inlet as required for filling or emptying a tank to a desired level is selectively adjustable generally axially with respect to said neck section by applying generally axial pushing force against said siphon inlet in the direction of said fluid entry section of said body or against said bow sector in the direction of said neck section of said body.

In certain preferred embodiments:

(a) wall seal means is provided in said aperture means and sealingly engages and surrounds said tube siphon means with substantial frictional contact and frictionally maintains the position of said tube siphon means therethru, wherein said frictional contact is sufficient to prevent movement of said tube siphon means thru said seal wall means in response to said pushing force, and wherein said lateral frictional contact of said suction end segment with said inner wall portion of said neck section is sufficient to maintain a desired bow configuration of said suction end segment and consequently also a desired position of said siphon inlet with respect to said neck section;

(b) the tube siphon means comprises vinyl tubing of from about 1/8" to about 5/16" inside diameter and having a wall thickness of from about 1/32" to about 3/32";

(c) the inclusive angle between the bore axis of said aperture means and the flow axis of said neck section is from about 30° to about 90° ; and (d) said pressure seal means comprises a generally ring-shaped cushion of compressible elastomeric foamed material which is dimensioned and adapted to conform to practically any perimeter wall of any gasoline or other petrol tank fill port to provide a pressure seal between said body and said perimeter wall.

BRIEF DESCRIPTION OF THE DRAWINGS

The invention will be further understood from the following drawings of certain preferred embodiments and the description thereof, wherein.

DETAILED DESCRIPTION OF THE DRAWINGS

Figure 5:
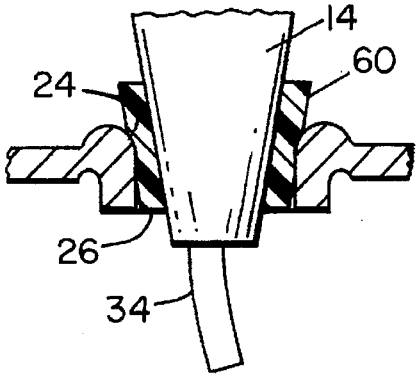
FIG. 5 is a cross-sectional view of a further stopper-type embodiment of the pressure seal means.
Figure 1:
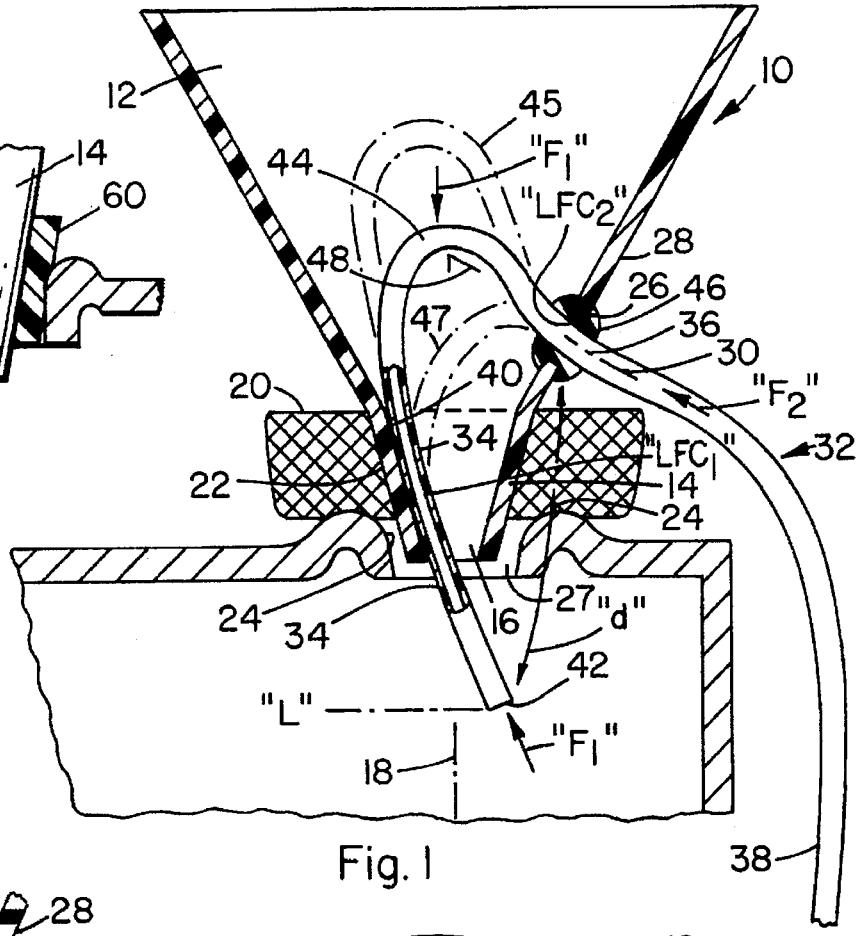
FIG. 1 is a longitudinal, principally cross-sectional view of the present funnel device taken along line 1—1 of FIG. 2.

Referring to the drawings and with reference to the claims hereof, the present funnel device having adjustable fill regulator means for pouring fluids into a receptacle thru a fill port therein defined by a perimeter wall, comprises said device comprising a funnel shaped body having a wide-mouthed fluid entry section 12 and an integral tubular neck section 14 having a fluid exit 16 and a flow axis 18, pressure seal means 20 on an exterior circumferential surface portion 22 of said body and adapted to engage the perimeter wall 24 of a fill port 27 and form a hermetic seal between said circumferential surface portion 22 and said perimeter wall 24, aperture means 26 formed thru a wall portion 28 of said entry section 12 and having a bore axis 30, and flexible siphon tube means generally designated 32 having a suction end segment 34, an intermediate segment 36 and a discharge end segment 38, said discharge end segment extending outwardly of said body 10, said intermediate segment 36 being sealingly mounted in and thru said aperture means 26 with said suction end segment 34 extending into said entry section 12 and said neck section 14 and making lateral frictional contact, LFC, with an inner wall portion 40 of said neck section 14, said suction end segment 34 having a siphon inlet 42 adapted for positioning within said neck section 14 or completely therethrough and protruding beyond said fluid exit 16, said suction end segment 34 being movable against said frictional contact in a generally flow axial direction within said neck section for positioning said siphon inlet 42 generally axially with respect to said neck section 14, said suction end segment 34 having a bow sector 44 adjacent said aperture means 26, the adjusted curvature configuration of said bow sector 44, e.g., as shown by the dotted lines 45 and 47 being determined approximately by the adjusted distance "d" between said aperture means 26 and said siphon inlet 42, wherein the position of said siphon inlet as required for filling a tank to a desired level such as "L" is selectively adjustable generally axially with respect to said neck section 14 by applying generally axial pushing force "$F_1$," against either said siphon inlet in the direction of said fluid entry section 12 of said body or against said bow sector 44 in the direction of said neck section 14 of said body, whereby said lateral frictional contact, "$LFC_1$", is overcome by said pushing force "F" and said siphon inlet is moved generally axially and the configuration of said bow sector is altered to accommodate the change in position of said siphon inlet.

The sealing of segment 36 in aperture 26 is preferably done by means of a wall seal means 46 in the form of an elastomeric grommet of gasoline resistant material provided in said aperture. This grommet sealingly engages and surrounds the siphon tube at its intermediate segment 36 with substantial lateral frictional contact, "$LFC_2$", and frictionally maintains the position of the tube therethru. The frictional contact, "$LFC_2$", is sufficient to prevent movement of the tube thru the grommet when a pushing force "F" is being applied to the suction end segment 34 for adjusting the position of the siphon inlet 42.

The lateral frictional contact, "$LFC_1$", of the suction end segment with the inner wall portion 40 of the neck section is sufficient to maintain a desired bow configuration of the suction end segment and consequently also a desired position of the siphon inlet 42 with respect to the neck section.

The relationship between the frictional contacts, "$LFC_1$" and "$LFC_2$" should be such that the force "$F_2$" which must be exerted on intermediate segment 36 along the bore axis 30 to move it thru the grommet substantially exceeds the force "$F_1$" which must be exerted on segment 34 to move it generally along the flow axis 18. For example, where "$F_1$" is from about 0.5 to about 1.5 lbs, "$F_2$" should be from about 2.0 to about 3.0 lbs. It is noted that "$LFC_2$" should not be too high such that the siphon tube cannot be readily inserted thru the grommet upon assembly of the device.

Figure 3:
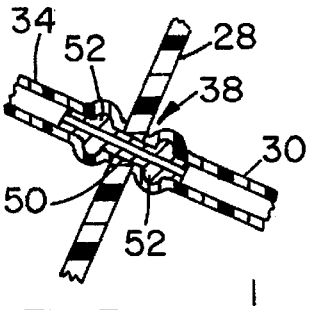
FIG. 3 is a cross-sectional view of the apertured portion of the funnel wall showing a variation in siphon tube mounting structure.
Figure 2:
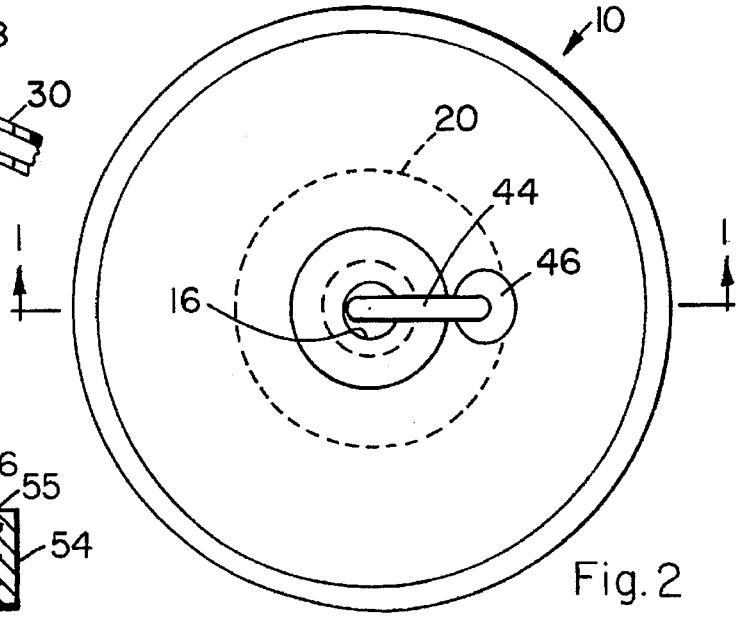
FIG. 2 is a top elevational view of the device of FIG. 1.

In this regard however, and as shown in the embodiment of FIG. 3, the intermediate segment 36 may be fixed in sealed position thru wall portion 28 by means of a tubular connector 50 inserted thru aperture 26 and adhesively or otherwise sealingly affixed to wall portion 28. This connector is provided with two or more circumferential ridges 52 over which discharge end segment 38 and suction end segment 34 are pushed and held in sealed assembled positions as shown.

The siphon tube means preferably comprises vinyl tubing of from about 1/8" to about 5/16" inside diameter and having a wall thickness of from about 1/32" to about 3/32". The tube, however, can be of any material which is resistant to fuel chemcials or other hazardous fluids, e.g., PVC, styrene, polyester, polyurethane, polyamide, polybutylene, polyolefins, polybutadiene, polyimide or the like which can provide adequate rigidity to give the aforesaid "frictional contacts".

It is preferred that the inclusive angle 48 between the bore axis 30 of said aperture means and the flow axis 18 of said neck section is from about 30° to about 90°. This angle has been found to form a bow configuration of the siphon tube which affords excellent siphon inlet adjustment.

The said pressure seal means 20 preferably comprises a generally ring-shaped cushion of compressible elastomeric foamed material which is dimensioned and adapted to conform to practically any perimeter wall of any gasoline or other petrol tank fill port to provide a hermetic pressure seal between said body and said perimeter wall. The elastomeric chemical materials may comprise any of those mentioned above. The seal means may also comprise, e.g., a conventional screw-on cap type structure as shown in FIG. 5.

Figure 4:
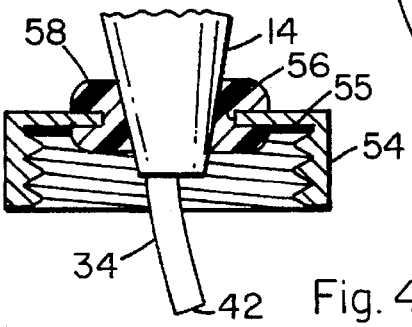
FIG. 4 is a cross-sectional view of an alternative screw-on cap type embodiment of the pressure seal means.

Referring to FIG. 4, a typical threaded screw-on cap 54 is provided with an opening 56 having a sealing grommet 58 fixed therein and which sealingly receives the neck section 14 of the funnel. The cap 54 is provided with an annular gasket 55 for sealing against the perimeter wall 24 or other such structure of the tank fill port 27.

Referring to FIG. 5, an elastomeric stopper 60 is fixed to neck section 14 and seals against the perimeter wall 24 or other such structure of the tank fill port 27.

In using the present device, the fill or emptying level "L" is selected by adjusting the position of inlet 42 with respect to neck section 14 and the funnel positioned and forced onto the tank such that a fluid-tight seal is made by the pressure seal means 20 against the fill port perimeter or equivalent structure of the tank. The funnel is then continuously filled sufficiently to raise the fluid to and over the bow sector to begin the siphoning process.

The invention has been described in detail with particular reference to preferred embodiments thereof, but it will be understood that variations and modifications will be effected within the spirit and scope of the invention.

I claim:

1. A funnel device having adjustable fill regulator means for pouring fluids into a receptacle thru a fill port therein defined by a perimeter wall, said device comprising a funnel shaped body having a wide-mouthed fluid entry section and an integral tubular neck section having a fluid exit and a flow axis, pressure seal means on an exterior circumferential surface portion of said body and adapted to engage the perimeter wall of said fill port and form a hermetic seal between said circumferential surface portion and said perimeter wall, aperture means formed thru a wall portion of said entry section and having a bore axis, and flexible siphon tube means having a suction end segment, an intermediate segment and a discharge end segment, said discharge end segment extending outwardly of said body, said intermediate segment being sealingly mounted in and thru said aperture means with said suction end segment extending into said entry section and said neck section and making lateral frictional contact with an inner wall portion of said neck section, said suction end segment having a siphon inlet adapted for positioning within said neck section or completely therethrough and protruding beyond said exit, said suction end segment being movable against said frictional contact in a generally flow axial direction within said neck section for positioning said siphon inlet generally axially with respect to said neck section, said suction end segment having a bow sector adjacent said aperture means, the curvature configuration of said bow sector being determined approximately by the adjusted distance between said aperture means and said siphon inlet, wherein the position of said siphon inlet as required for filling or emptying a tank to a desired level is selectively adjustable generally axially with respect to said neck section by applying generally axial pushing force against said siphon inlet in the direction of said fluid entry section of said body or against said bow sector in the direction of said neck section of said body.

2. The device of claim 1 wherein wall seal means is provided in said aperture means and sealingly engages and surrounds said tube siphon means with substantial frictional contact and frictionally maintains the position of said tube siphon means therethru, wherein said frictional contact is sufficient to prevent movement of said tube siphon means thru said seal wall means in response to said pushing force, and wherein said lateral frictional contact of said suction end segment with said inner wall portion of said neck section is sufficient to maintain a desired bow configuration of said suction end segment and consequently also a desired position of said siphon inlet with respect to said neck section.

3. The device of claim 1 wherein the tube siphon means comprises vinyl tubing of from about 1/8" to about 5/16" inside diameter and having a wall thickness of from about 1/32" to about 3/32".

4. The device of claim 1 wherein the inclusive angle between the bore axis of said aperture means and the flow axis of said neck section is from about 30° to about 90°.

5. The device of claim 1 wherein said pressure seal means comprises a generally ring-shaped cushion of compressible elastomeric foamed material which is dimensioned and adapted to conform to practically any perimeter wall of any gasoline or other petrol tank fill port to provide a pressure seal between said body and said perimeter wall.

* * * * *